US010568801B2

(12) United States Patent
Yoshida et al.

(10) Patent No.: US 10,568,801 B2
(45) Date of Patent: Feb. 25, 2020

(54) CHAIR TYPE MASSAGE MACHINE AND METHOD FOR MANUFACTURING THE SAME

(71) Applicant: FUJI MEDICAL INSTRUMENTS MFG. CO., LTD., Osaka-shi, Osaka (JP)

(72) Inventors: Toshihisa Yoshida, Osaka (JP); Hironori Yasuda, Osaka (JP)

(73) Assignee: FUJI MEDICAL INSTRUMENTS MFG. CO. LTD., Osaka-shi (JP)

( * ) Notice: Subject to any disclaimer, the term of this patent is extended or adjusted under 35 U.S.C. 154(b) by 982 days.

(21) Appl. No.: 15/009,597

(22) Filed: Jan. 28, 2016

(65) Prior Publication Data

US 2016/0310347 A1 Oct. 27, 2016

(30) Foreign Application Priority Data

Apr. 24, 2015 (JP) ..... 2015-089612

(51) Int. Cl.
*A61H 7/00* (2006.01)
*A61H 9/00* (2006.01)

(52) U.S. Cl.
CPC ..... *A61H 7/001* (2013.01); *A61H 9/00* (2013.01); *A61H 2201/0149* (2013.01);
(Continued)

(58) Field of Classification Search
CPC ..... A61H 7/001; A61H 2201/0149; A61H 2201/1614; A61H 2201/1685;
(Continued)

(56) References Cited

U.S. PATENT DOCUMENTS 4,084,775 A * 4/1978 Pelly ..... A47C 7/02 297/452.42
4,322,111 A * 3/1982 Barley ..... B60N 2/38 297/357

(Continued)

FOREIGN PATENT DOCUMENTS

CN 103096862 5/2013
JP S48-28059 4/1973

(Continued)

OTHER PUBLICATIONS

English translation for JP2014034215, espacenet.com, translated on Dec. 7, 2018.*

(Continued)

*Primary Examiner* — Tu A Vo
(74) *Attorney, Agent, or Firm* — Masuvalley & Partners

(57) ABSTRACT

A chair type massage machine 100 includes a seat part 200, a backrest part 300 which is rotatably supported at the back of the seat part 200 and is capable of reclining, a base part 400 provided at the left and right sides of the seat part 200, arm treatment parts 500 provided above the base part 400, and which move front and back with respect to the base part 400 to treat a forearm of a person to be treated, and an operation unit 700 which receives operation inputs by the person to be treated. The backrest part 300 includes a frame 310, and the frame 310 is made from a first frame 311 and a second frame 312.

5 Claims, 7 Drawing Sheets

(52) U.S. Cl.
CPC ..... *A61H 2201/1409* (2013.01); *A61H 2201/168* (2013.01); *A61H 2201/1614* (2013.01); *A61H 2201/1616* (2013.01); *A61H 2201/1626* (2013.01); *A61H 2201/1685* (2013.01); *A61H 2203/0425* (2013.01); *A61H 2205/062* (2013.01); *A61H 2205/081* (2013.01)

(58) Field of Classification Search
CPC ..... A61H 2205/062; A61H 2201/168; A61H 2201/0138; A61H 7/00; A61H 7/002; A61H 7/007; A61H 7/008; A61H 2007/009; A61H 9/00; A61H 9/005; A61H 9/0078; A61H 9/0085
See application file for complete search history.

(56) References Cited

U.S. PATENT DOCUMENTS 4,574,786 A * 3/1986 Hashimoto ..... A61H 1/00 297/284.1
4,641,884 A * 2/1987 Miyashita ..... B60N 2/2252 297/284.1
5,792,082 A * 8/1998 Yamanaka ..... A61H 9/0078 601/148
6,689,077 B2 * 2/2004 Dabir ..... A61H 7/001 601/134
2001/0011160 A1 * 8/2001 Oguma ..... A61H 7/004 601/89
2002/0003366 A1 * 1/2002 Fourrey ..... A47C 7/14 297/284.1
2004/0158181 A1 * 8/2004 Watanabe ..... A61H 7/007 601/99
2007/0208284 A1 * 9/2007 Huang ..... A61H 7/001 601/112
2008/0146422 A1 * 6/2008 Bae ..... A47C 9/002 482/130
2010/0069801 A1 * 3/2010 Tsai ..... A63B 21/0552 601/134
2010/0210979 A1 * 8/2010 Tsutsui ..... A47C 7/425 601/24
2011/0133525 A1 * 6/2011 Oota ..... B60N 2/5635 297/180.14
2011/0278890 A1 * 11/2011 Takahashi ..... A47C 31/11 297/284.1
2012/0157899 A1 * 6/2012 Terada ..... A61H 9/0078 601/149
2012/0316478 A1 * 12/2012 Inada ..... A61H 7/007 601/126
2013/0226051 A1 * 8/2013 Lu ..... A61H 7/007 601/99
2014/0070594 A1 * 3/2014 Awata ..... B60N 2/5825 297/452.48
2014/0343467 A1 * 11/2014 Fukuyama ..... A61H 7/007 601/98

FOREIGN PATENT DOCUMENTS

JP S53-139311 U 11/1978
JP S62-102710 A 5/1987
JP 2004-057428 A 2/2004
JP 2006-149466 A 6/2006
JP 2013-146487 A 8/2013
JP 2013-244239 A 12/2013
JP 2014-034215 A 2/2014
JP 2014034215 A * 2/2014
JP 2014-200445 A 10/2014
JP 2015-019891 A 2/2015

OTHER PUBLICATIONS

SIPO, Notification of First Office Action issued in Chinese Patent Application No. 201620074888.8, dated May 11, 2016, total 5 pages with English translation.
Japan Patent Office, Notice of Rejection dated Oct. 16, 2018 in JP Patent Application No. 2015-089612, total 11 pages with English translation.

* cited by examiner

CHAIR TYPE MASSAGE MACHINE AND METHOD FOR MANUFACTURING THE SAME

This application claims priority under 35 U.S.C. § 119 to Japanese patent application Serial No. 2015-089612, filed Apr. 24, 2015 which is incorporated herein by reference in its entirety.

FIELD OF THE INVENTION

The present invention pertains to a chair type massage machine and to a method for manufacturing the same.

BACKGROUND OF THE INVENTION

Research and development of chair type massage machines have been performed in the past. A chair type massage machine that is capable of sufficiently stretching the dorsal muscles is known.

The massage device described is a chair type massage device provided with a chair body having a seat part and a backrest part provided at the seat part, airbags provided at surfaces of the chair body which abut the user's body, and an air supply and exhaust device for inflating and deflating the airbags; wherein the backrest part is divided into an upper backrest part and a lower backrest part at a center part in the longitudinal direction; and the upper backrest part is supported rotatably in the rear direction with respect to the lower backrest part by a rotation retention mechanism provided between the upper backrest part and the lower backrest part, and is retained at a prescribed rotation angle.

Furthermore, a massage machine capable of sufficiently securing an extension and contraction amount of the pad members to thereby perform an excellent massage without inhibiting the motions of treatment elements is known.

The massage machine is provided with a massage part for massaging a region to be treated, and a pad member interposed between the region to be treated and the massage part to support the region to be treated, and the pad member has an extension/contraction part for assisting extension and contraction in the body height direction.

SUMMARY OF THE INVENTION

A chair type massage machine according to one embodiment is a chair type massage machine having a backrest part, wherein the backrest part has a frame, and a material hardness of the frame varies by location.

DETAILED DESCRIPTION OF THE PREFERRED EMBODIMENTS

Figure 1:
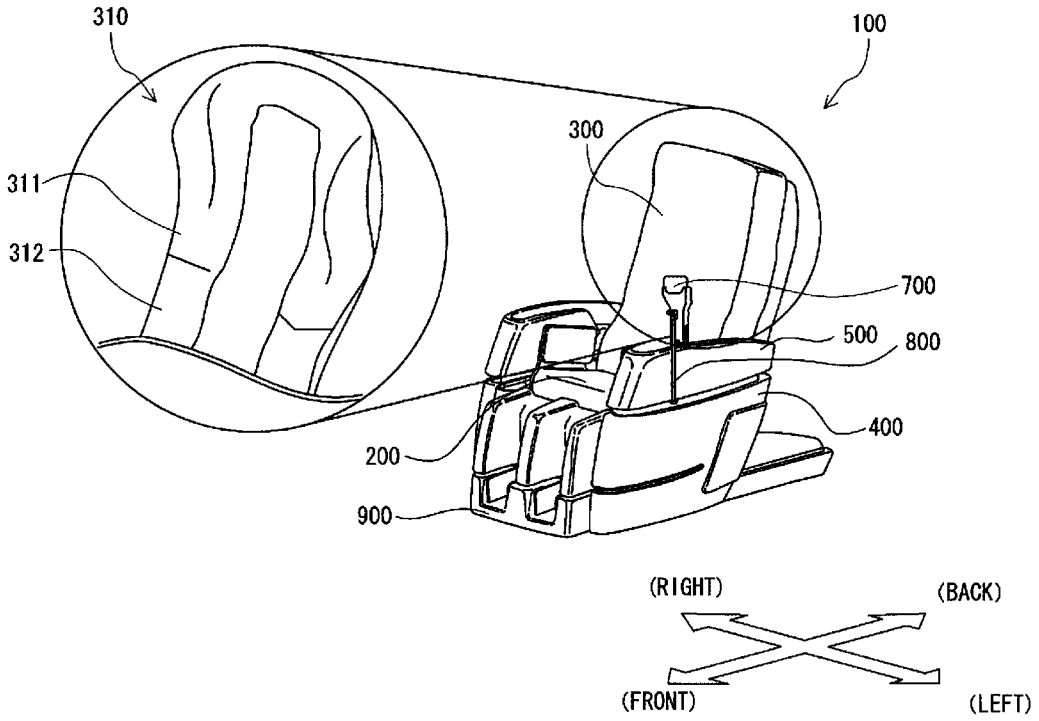
FIG. 1 is a schematic view showing one example of a chair type massage machine and a frame.

Embodiments of the present invention are described below with reference to the drawings. In the following descriptions, the same reference numerals are given to parts which are the same. The names and functions of those parts are also the same, and therefore detailed descriptions of those parts are not repeated.

First Embodiment

FIG. 1 is a schematic view showing one example of a chair type massage machine 100 and a frame 310.

As shown in FIG. 1, the chair type massage machine 100 has a seat part 200, a backrest part 300, a base part 400, an arm treatment part 500, an operation unit 700, a stand 800, and a leg rest part 900.

Moreover, the enlarged view of FIG. 1 is a schematic view showing an internal structure of the backrest part 300.

Also, for explanatory purposes, as shown in FIG. 1, with the chair type massage machine 100, the side at which the backrest part 300 is formed in the seat part 200 is assumed to be the back, the side that is opposite of the back is assumed to be the front, and the left and right sides thereof are referred to as the left and the right.

The backrest part 300 is provided at the back of the seat part 200 of the chair type massage machine 100, and the leg rest part 900 is provided at the front of the seat part 200. A pair of base parts 400 is provided at the right and the left sides of the seat part 200. Furthermore, respective arm treatment parts 500 are provided on top of the base parts 400.

The stand 800 is provided at the side of at least one of the arm treatment parts 500 between the base part 400 and the arm treatment part 500, and the operation unit 700 is retained by the stand 800.

An outer cover having a cushioning property is attached to a frame of the seat part 200 of the chair type massage machine 100. Furthermore, a space for allowing movement of treatment elements (not illustrated) is formed in the center of the backrest part 300. In addition, an outer cover and a pillow having cushioning properties are attached to the backrest part 300.

A treatment unit is built into the inside of the arm treatment part 500, and a treatment unit is also built into the inside of the leg rest part 900. Note that the treatment unit is, for example, a device which performs treatment through air pressure.

The person to be treated sits on the seat part 200, rests his or her back against the backrest part 300, and inserts his or her forearms into the arm treatment parts 500. Furthermore, the person to be treated also inserts both legs into the leg rest part 900, and then operates the operation unit 700 in order to receive a massage.

[Frame 310]

Figure 2:
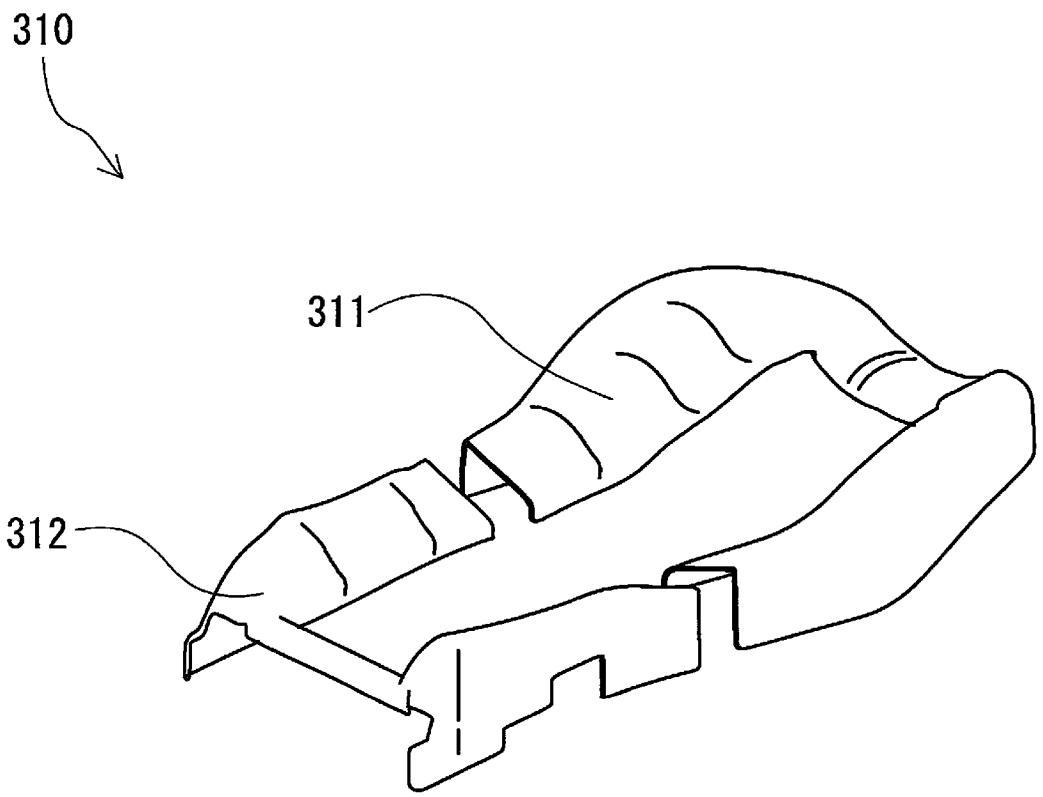
FIG. 2 is a schematic view showing an example of a frame.

Next, FIG. 2 is a schematic view showing an example of the frame 310. As described above, and as shown in the enlarged view of FIG. 1, the frame 310 is located inside the backrest part 300. As shown in FIG. 2, with the present embodiment, the frame 310 includes a first frame 311 and a second frame 312.

The frame 310 is made from a square-shaped frame body. A region in which treatment elements (not illustrated) can move is formed inside the frame 310.

Furthermore, the first frame 311 of the frame 310 is made from a U-shape, and the second frame 312 is also made from a U-shape. The frame 310, which is made from a square-shaped frame body, is formed by mutually connecting each of the U-shaped end parts of the first frame 311 and the second frame 312.

The frame 310 is made from a shape which is capable of supporting the back of a person to be treated, and the right and the left sides rise upward. Moreover, the first frame 311 of the frame 310 is a portion which supports the upper portion of the back of a person to be treated, and the second frame 312 is a portion which supports the lower back, and particularly the lumbar region of the person to be treated.

In the present embodiment, the respective end parts of the first frame 311 and the second frame 312 are secured by welding for example. Moreover, the first frame 311 is made from molded urethane, and the second frame 312 is made from resin or metal.

Note that with the above-described embodiment, the first frame 311 and the second frame 312 were welded, but the present invention is not limited thereto, and the first frame 311 and the second frame 312 may be secured by screws or mated, or a plurality of measures thereof may be used.

Moreover, in the above-described embodiment, the first frame 311 was made from molded urethane and the second frame 312 was made from resin or metal, but the present invention is not limited thereto, and both the first frame 311 and the second frame 312 may be made from molded urethane as long as the hardness values thereof are mutually different.

In particular, the hardness of the first frame 311 is preferably softer than the hardness of the second frame 312. In this case, the first frame 311 and the second frame 312 are made from the same material, and therefore the first frame 311 and the second frame 312 can be easily connected.

Furthermore, because the second frame 312 is made from a material having a hardness that is harder than that of the first frame 311, the lumbar region of the person to be treated can be firmly supported (held). In addition, because the first frame 311 is made from a material which is softer than that of the second frame 312, the upper back part (shoulders, etc.) of the person to be treated can be more softly supported.

Also, because the hardness of the frame 310 is varied, changes in hardness due to changes over time can be prevented.

[Frame 310*a*]

Figure 3:
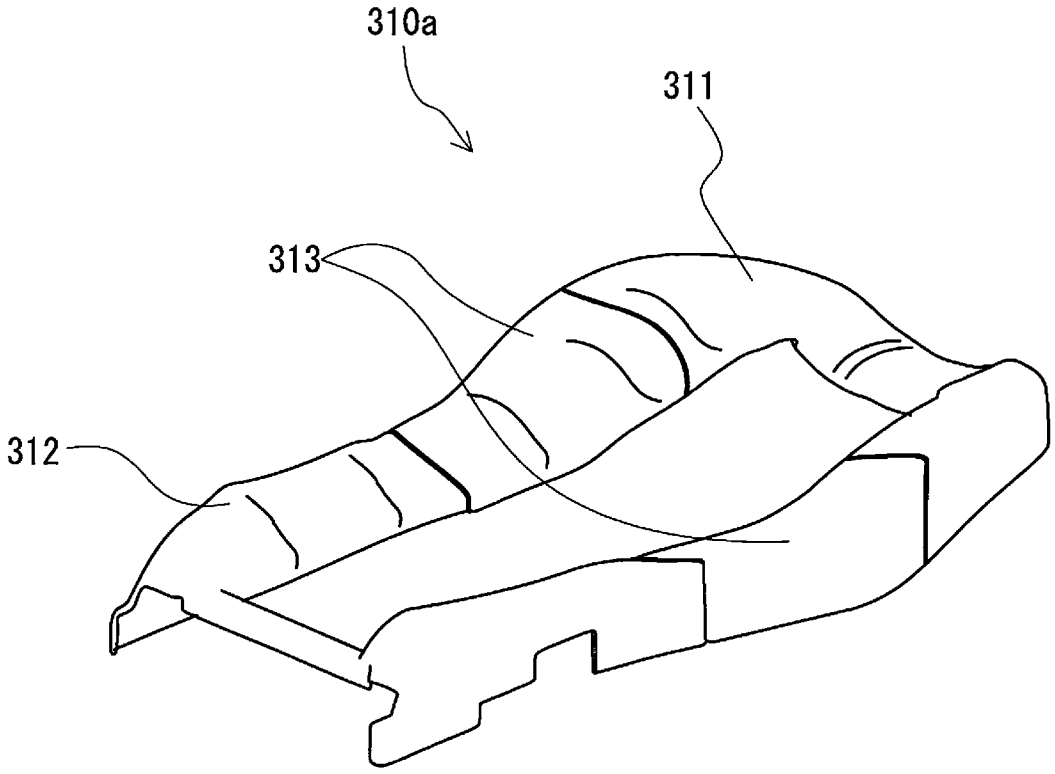
FIG. 3 is a schematic view showing an example of a frame.

Next, FIG. 3 is a schematic view of an example of a frame 310*a*. The points of the frame 310*a* which differ from those of the frame 310 are primarily described, while the portions that are not described are the same as those of the frame 310.

As shown in FIG. 3, the frame 310*a* includes a first frame 311, a second frame 312, and third frames 313. The frame 310*a* is provided with the third frames 313 between the first frame 311 and the second frame 312. Similar to the frame 310, the frame 310*a* is also made from a square-shaped frame body. Therefore, like the frame 310, the first frame 311 and the second frame 312 are made mutually of U-shapes. Furthermore, the third frames 313 are a pair of linear shaped frame bodies. The respective third frames 313 are provided between the first frame 311 and the second frame 312.

In the above description, the hardness of the first frame 311 is the same as that of the third frame 313 or is softer than the hardness of the third frame 313, and the hardness of the third frame 313 is softer than that of the second frame 312.

As a result, the lumbar region of a person to be treated can be reliably supported by the second frame 312, and the upper back portion (shoulders, etc.) of the person to be treated can be softly supported by the third frame 313 and the first frame 311.

[Frame 310*b*]

Figure 4:
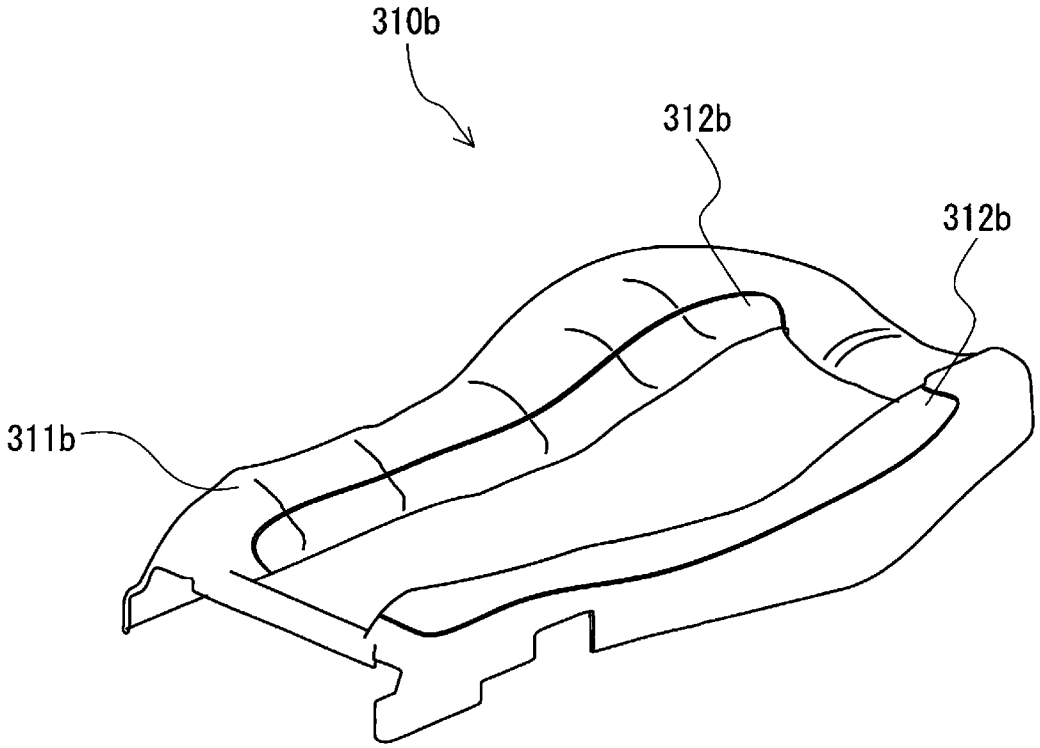
FIG. 4 is a schematic view showing an example of a frame.

Next, FIG. 4 is a schematic view showing an example of a frame 310*b*. The points of the frame 310*b* which differ from those of the frame 310 are primarily described, while the portions that are not described are the same as those of the frame 310.

As shown in FIG. 4, the frame 310*b* includes a first frame 311*b* and a pair of second frames 312*b*.

The first frame 311*b* is made from a square-shaped frame body, and the respective second frames 312*b* of the pair are attached to the right and left sides of the inside of the square-shaped frame body of the first frame 311*b*.

Note that the pair of second frames 312*b* is made from metal or resin, and the first frame 311*b* is made from molded urethane.

The first frame 311*b* and the pair of second frames 312*b* may use one of any of welding, fastening by screws, or mating, or may use a combination of a plurality thereof.

In this case, the spine of the person to be treated can be reliably supported by the pair of second frames 312*b*, and portions other than the spine of the person to be treated can be gently supported by the first frame 311*b*.

[Frame 310*c*]

Figure 5:
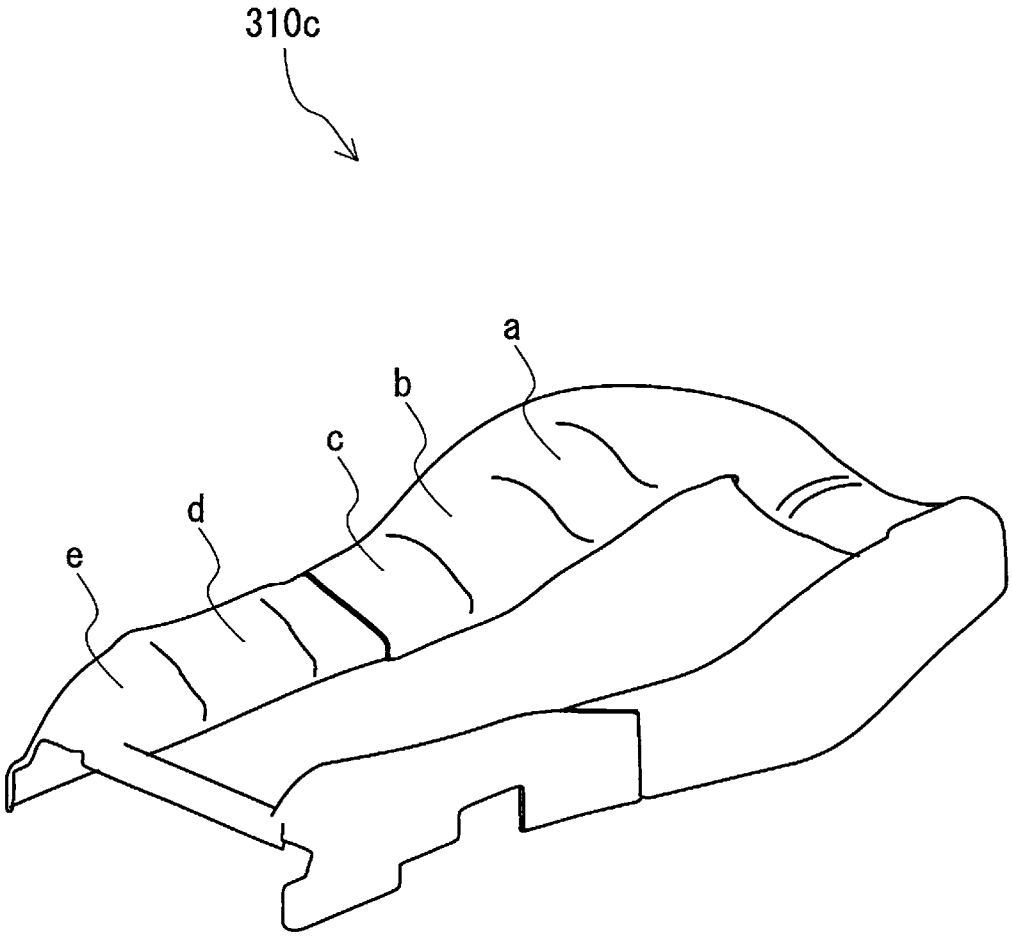
FIG. 5 is a schematic view showing an example of a frame.

Next, FIG. 5 is a schematic view showing an example of a frame 310*c*. The points of the frame 310*c* which differ from those of the frame 310 are primarily described, while the portions that are not described are the same as those of the frame 310.

As shown in FIG. 5, the frame 310*c* is made from a same system of material, and is formed such that the material hardness varies gradually at the locations a, b, c, d, and e. For example, the locations a to e may be formed from molded urethane, and may be formed such that the hardness becomes continuously harder moving from location a to location e.

Note that the hardness of the frame 310*c* varies continuously, but the frame 310*c* is not limited thereto, and the hardness values from location a to location e may be changed in steps.

As a result, the lumbar region of the person to be treated can be reliably supported by the location e, while the upper back area (shoulders, etc.) of the person to be treated can be gradually more softly supported moving continuously from the location d to location c, location b, and location a.

[Frame 310*d*]

Figure 6:
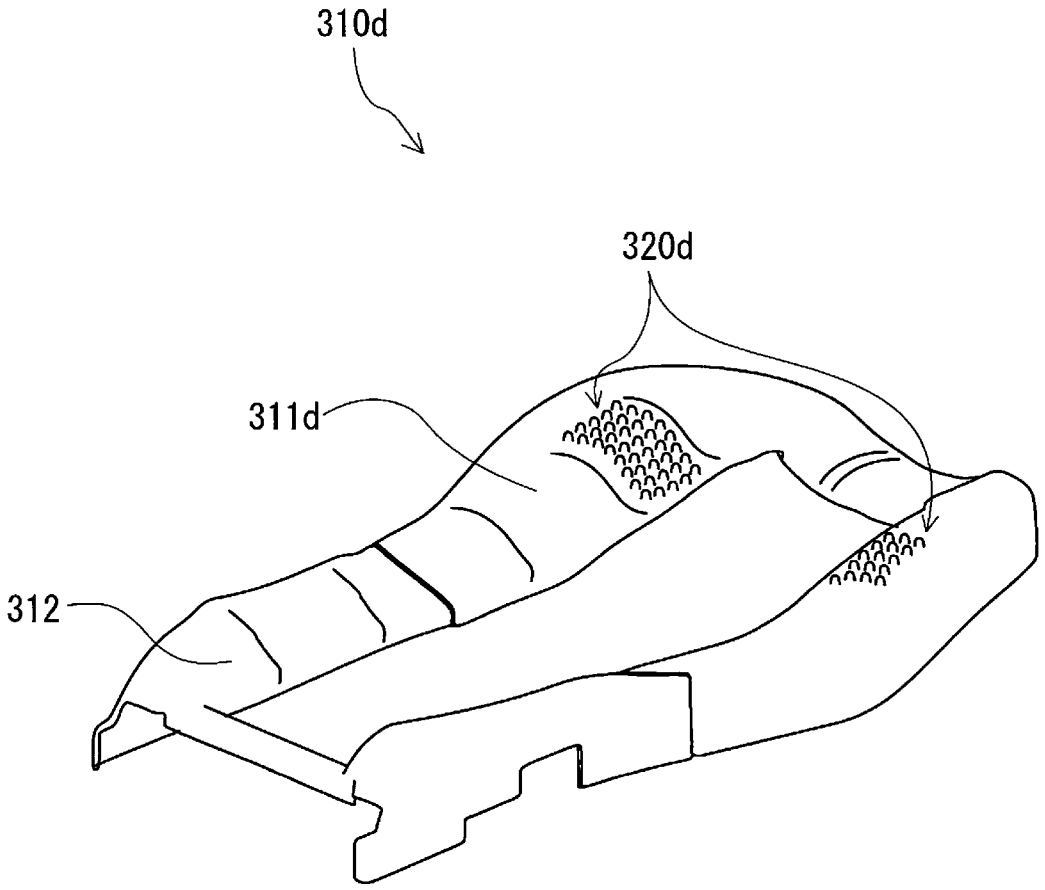
FIG. 6 is a schematic view showing an example of a frame.

Next, FIG. 6 is a schematic view showing an example of a frame 310*d*. The points of the frame 310*d* which differ from those of the frame 310 are primarily described, while the portions that are not described are the same as those of the frame 310.

As shown in FIG. 6, the frame 310*d* is made from a first frame 311*d* and a second frame 312.

Also, unlike the first frame 311 of FIG. 2, a plurality of protruding locations 320*d* are formed on the first frame 311*d*. The plurality of protruding locations 320*d* shown in FIG. 6 are formed through molded urethane.

Accordingly, if the first frame 311*d* is formed from molded urethane, the plurality of protruding locations 320*d* can likewise be integrally molded.

Note that the protruding locations 320*d* are formed at a portion of the first frame 311*d*, but the present invention is not limited thereto. The protruding locations 320*d* may be formed over the entire first frame 311*d*, and if the second frame 312 is formed from molded urethane, the protruding locations 320*d* may also be formed on the entire surface of the second frame 312.

Note that the hardness of the protruding locations 320*d* may be the same as that of the first frame 311*d*, or the protruding locations 320*d* may be formed so as to be softer than the first frame 311*d*, and the hardness of the first frame 311*d* is formed so as to be softer than the second frame 312.

[Frame 310*e*]

Figure 7:
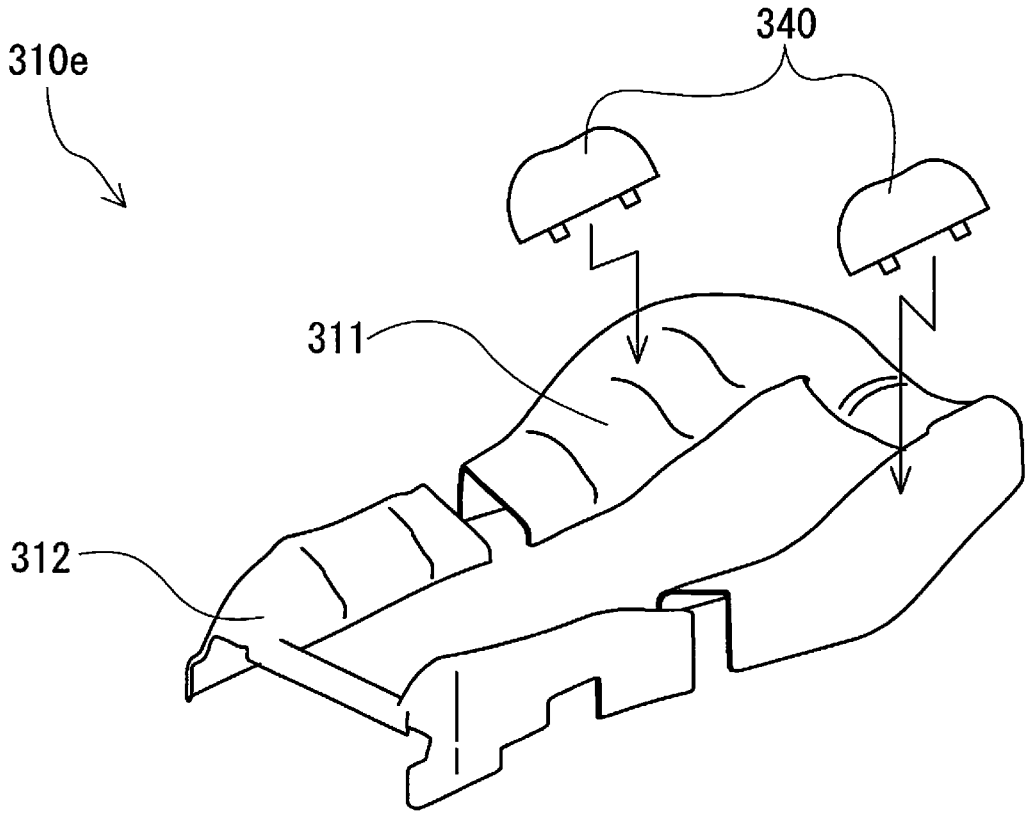
FIG. 7 is a schematic view showing an example of a frame.

Next, FIG. 7 is a schematic view showing an example of a frame 310*e*. The points of the frame 310*e* which differ from those of the frame 310 are primarily described, while the portions that are not described are the same as those of the frame 310.

As shown in FIG. 7, the frame 310*e* includes a first frame 311, a second frame 312, and a pair of shoulders frames 340.

The pair of shoulder frames 340 is obtained by molding and forming resin at a perimeter area with respect to a metal frame. In addition, the shoulder frames 340 of the pair are respectively attached to the right and left parts of the first frame 311.

As described above, the frame hardness differs depending on the location in the backrest part 300 of the chair type massage machine 100. In particular, the hardness values of the first frame 311 and the second frame 312 differ.

The first frames 311, 311*b*, and 311*d* have hardness values that are softer than those of the second frames 312 and 312*b*, and therefore the hardness can be easily varied.

Accordingly, the lumbar region of a person to be treated can be firmly supported, while the upper back portion (shoulders) can be softly supported.

Moreover, the spinal region of a person to be treated can be firmly supported, while the area around the spine can be softly supported. As a result, the bodily sensation of the person to be treated can be improved.

In the present invention, the backrest part 300 corresponds to a "backrest part", the chair type massage machine 100 corresponds to a "chair type massage machine", the first frames 311, 311*b*, and 311*d* correspond to a "first frame", the second frames 312 and 312*b* correspond to a "second frame", the plurality of protruding locations 320*d* corresponds to "multiple point projections", and the pair of shoulder frames 340 corresponds to a "shoulder holding part".

Preferred embodiments of the present invention are as described above, but the present invention is not restricted to only those embodiments, and it shall be understood that various embodiments may be adapted in other manners without departing from the spirit or scope of the present invention. Furthermore, the actions and effects obtained from the present invention were described for the present embodiments, but these actions and effects are just one example, and do not limit the present invention.

It should be noted that the hardness of the frame varies by location in the backrest part of the chair type massage machine. Accordingly, the hardness of the frame corresponding to the lumbar region and back region of a person to be treated can be varied, and the bodily sensation can be improved. In addition, it is possible to provide further improvements in bodily sensation from massaging. In particular, it is possible to provide a chair type massage machine which provides bodily sensation over time without requiring maintenance.

For example, the lumbar region can be firmly supported, and the cushioning property of the back region can be increased. Moreover, the side near the spinal region of a person to be treated can be firmly supported, while the cushioning property at a side that is further away from the spinal region of the person to be treated can be increased. As a result, the bodily sensation of the person to be treated can be increased. Furthermore, by varying the hardness of the frame, changes over time in hardness through long-term use can be suppressed.

(2) A chair type massage machine according to a second embodiment is the chair type massage machine according to the first aspect, wherein the backrest part may include at least a first frame, and a second frame having a hardness which differs from that of the first frame.

In this case, the material hardness can be easily varied by location by including a first frame and a second frame having a hardness which differs from that of the first frame.

Note that the backrest part may include a first frame, a second frame, a third frame, and up to an nth frame (n: a positive integer), and the material hardness of some of those frames may differ from that of the other frames.

(3) A chair type massage machine according to a third embodiment is the chair type massage machine according to the second embodiment, wherein the second frame is disposed at a position in relation to a lumbar region of a person to be treated, the first frame is disposed at a position in relation to a back region of the person to be treated, and the first frame and the second frame may be connected.

In this case, the first frame and the second frame are connected, the lumbar region of the person to be treated is held by the second frame, and the back region of the person to be treated is held by the first frame.

(4) A chair type massage machine of a fourth embodiment is a chair type massage machine according to the second or third embodiments, wherein at least one of the first frame and the second frame is formed from molded urethane.

In this case, at least one of the first frame and the second frame is formed from molded urethane, and therefore the first frame and the second frame may be formed from molded urethane, or only the first frame may be formed from molded urethane, and the second frame may be molded from resin.

As a result, the material hardness can be easily varied.

(5) A chair type massage machine of a fifth embodiment is the chair type massage machine according to any one of the second to fourth embodiments, wherein the second frame has a material hardness value that is higher than that of the first frame.

In this case, the second frame has a hardness value of the material that is higher than that of the first frame, and therefore the second frame can be formed from a firm member, and the first frame can be formed from a flexible member. As a result, the bodily sensation of the person to be treated can be improved.

(6) A chair type massage machine of a sixth embodiment is the chair type massage machine according to the fourth or the fifth embodiment, wherein at least one of the first frame and the second frame has multiple point projections formed in at least one part.

In this case, multiple point projections are formed from at least one of the first frame and the second frame. Moreover, because multiple point projections are formed in at least one part of the first frame and the second frame, the body weight of a person to be treated can be supported by the multiple point projections.

(7) A chair type massage machine of a seventh embodiment is the chair type massage machine according to first aspect, wherein the frame of the backrest part is formed with the hardness of the frame material changing continuously.

In this case, the hardness of the frame material is gradually varied, and therefore the hardness of the frame corresponding to the lumbar region and the back region of the person to be treated can be gradually varied. For example, the lumbar region can be firmly supported, while the cushioning property at the back region can be increased, and the area between the back region and the lumbar region can be flexibly retained. Moreover, a side near the spinal region of a person to be treated can be firmly supported, while the cushioning property at a side that is further away from the spinal region of the person to be treated can be increased, and the area between the side near the spinal region and the side further away from the spinal region can be flexibly retained.

As a result, the bodily sensation of the person to be treated can be increased. Moreover, by continuously varying the hardness of the frame, the change in hardness over time from long-term use can be suppressed.

(8) A chair type massage machine of an eighth embodiment is the chair type massage machine according to any one of the first through seventh embodiments, further including a shoulder holding part formed projecting from the backrest part in order to hold the shoulders of the person to be treated; and the shoulder holding part includes at least a metal part.

In this case, the shoulder holding part includes at least a metal part, and therefore the shoulders of the person to be treated can be firmly retained.

(9) A method for manufacturing a chair type massage machine according to one embodiment is a method for manufacturing a chair type massage machine having a backrest part, the method including a connection step of connecting a first frame of the backrest part and a second frame having a hardness which differs from that of the first frame.

In this case, the first frame and the second frame, which has a different hardness, are connected, and therefore the hardness of the frame corresponding to the lumbar region and the back region of the person to be treated can be easily varied.

(10) A method for manufacturing a chair type massage machine according to yet another embodiment is a method for manufacturing a chair type massage machine having a backrest part, the method including an integral forming step of varying the hardness of the backrest part by location and integrally forming the backrest part.

In this case, the backrest is integrally formed with the hardness of the backrest part being varied by location, and therefore the hardness of the frame corresponding to the lumbar region and the back region of the person to be treated can be easily and gradually varied.

What is claimed is:

1. A chair massage machine having a backrest part, wherein the backrest part comprises a frame inside and the frame has a square-shaped frame body, wherein the frame comprises a first frame disposed at a position in relation to a back region of a person to be treated, a second frame disposed at a position in relation to a lumbar region of a person to be treated, and a shoulder holding part formed and projecting from the first frame, wherein the first frame is formed of a softer material than the second frame, and wherein the shoulder holding part comprises at least a metal part, wherein the first frame and the second frame are connected to form a single opening between the first frame and the second frame, wherein the single opening is configured to allow treatment elements to move.

2. The chair massage machine according to claim 1, wherein the shoulder holding part is formed by molding resin at a perimeter area with respect to a metal frame.

3. The chair massage machine according to claim 1, wherein at least one of the first frame and the second frame is formed from molded urethane.

4. The chair massage machine according to claim 1, wherein at least one of the first frame and the second frame has multiple point projections.

5. The chair massage machine according to claim 1, wherein each of the first frame and the second frame is formed with a hardness of the material of the frame changing continuously.

* * * * *